US006422920B1

(12) United States Patent
Bouten et al.

(10) Patent No.: US 6,422,920 B1
(45) Date of Patent: Jul. 23, 2002

(54) METHODS OF OBTAINING A PATTERN OF CONCAVE SPACES OR APERTURES IN A PLATE

(75) Inventors: Petrus Cornelis Paulus Bouten; Peter Jan Slikkerveer, both of Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/642,256

(22) Filed: Aug. 18, 2000

(30) Foreign Application Priority Data

Aug. 18, 1999 (EP) ..... 99202675

(51) Int. Cl.[7] ..... B24C 1/00
(52) U.S. Cl. ..... 451/29; 451/38; 451/78
(58) Field of Search ..... 451/29, 31, 30, 451/38–40, 78

(56) References Cited

U.S. PATENT DOCUMENTS 4,828,893 A * 5/1989 Tallman ..... 451/29
5,197,234 A * 3/1993 Gillenwater ..... 451/29
5,560,743 A * 10/1996 Imayama et al. ..... 451/2
5,730,635 A * 3/1998 De Haas et al. ..... 451/29
5,833,516 A 11/1998 De Haas et al.
5,924,912 A * 7/1999 Takahana et al. ..... 451/29
5,989,689 A * 11/1999 Komata ..... 451/29
6,276,992 B1 * 8/2001 Houda et al. ..... 451/29

FOREIGN PATENT DOCUMENTS

EP 0660360 A2 6/1995
JP 08222129 A 8/1996

OTHER PUBLICATIONS

Specification for PHN 16, 147, pp. 1–11.

* cited by examiner

*Primary Examiner*—George Nguyen
(74) *Attorney, Agent, or Firm*—Aaron Waxler

(57) ABSTRACT

The present invention relates to a method of obtaining a pattern of concave spaces or apertures in a plate or layer of a brittle-like material, in which method a jet of abrasive powder particles from a nozzle is directed onto a surface of the plate or layer, which plate or layer is provided with a mask so as to define the region of impact of the abrasive powder particles on the surface. The present invention also relates to a brittle-like material provided with such a pattern of concave spaces or apertures, and to the special application of such a brittle-like material.

17 Claims, 5 Drawing Sheets

METHODS OF OBTAINING A PATTERN OF CONCAVE SPACES OR APERTURES IN A PLATE

BACKGROUND OF THE INVENTION

The invention relates to a method of obtaining a pattern of concave spaces or apertures in a plate or layer of a brittle-like material, in which method a jet of abrasive powder particles from a nozzle is directed onto a surface of the plate or layer, which plate or layer is provided with a mask so as to define the region of impact of the abrasive powder particles on the surface. The invention also relates to a brittle-like material provided with such a pattern of concave spaces or apertures, and to the special application of such a brittle-like material.

The method mentioned in the opening paragraph is known per se from the previously filed European patent application 0 660 360 in the name of the Applicant. In accordance with the method of powder blasting, particles collide at a high velocity with a substrate, particularly glass. After the impact, they generate local damage in the substrate which may lead to the removal of the small fragments from the surface. This process is iterated many times and may thus be considered as an erosion process. A glass plate having a thickness of 0.7 mm is thus provided with a metal mask. The metal mask is adhered to the plate by means of an adhesive layer so as to prevent local delamination during the powder blasting process. A spraying unit provided with a nozzle is directed onto the surface of the plate, while a jet of abrasive powder particles, for example, silicon carbide or aluminum oxide leaves the nozzle on the basis of the pressure or venturi principle and lands on the surface of the plate or layer so as to form concave spaces or apertures therein. The angle at which the jet of abrasive powder particles extends to the plate or layer is thus 90°. It is further known from this European patent application to use a plurality of nozzles, while the plate performs, for example, an iterative movement parallel to the X axis and the spraying unit performs a movement parallel to the Y axis, with both velocities being adapted to each other in such a way that the desired aperture or pattern of concave spaces, particularly ducts, is obtained in the plate. For obtaining a better homogeneity of the desired pattern, it is also known from this document to use a plurality of nozzles, each of which is passed across a part of the mask. A drawback of such a method is that the jet of abrasive powder particles directed perpendicularly to the surface of the plate makes a hole of a special shape in the plate or layer. The manufacture of substantially symmetrical concave spaces or apertures having flat bottoms is, however, not possible with such a method. Moreover, the reproducible construction of concave spaces or apertures having substantially straight side walls is not possible.

OBJECT OF THE INVENTION

It is therefore an object of the present invention to provide a method of obtaining a pattern of concave spaces or apertures in a plate or layer of a brittle-like material, which concave spaces or apertures are characterized by a substantially flat bottom.

Another object of the present invention is to provide a method of obtaining a pattern of concave spaces or apertures in a plate or layer of a brittle-like material, which spaces or apertures have substantially straight side walls.

Another object of the invention is to provide a method of obtaining a pattern of concave spaces or apertures in a plate or layer of a brittle-like material, which spaces or apertures are interconnected.

According to the invention, the method described in the opening paragraph is characterized in that at least two jets of abrasive powder particles are each directed at respective angles of $\alpha_1$ and $\alpha_2$ onto the surface of the plate or layer, which jets mutually extend at an angle of $(180°-\alpha_{1-2})$, the shape of the concave spaces or apertures thus formed being not limited by the thickness of the brittle-like material.

The part of the phrase "at least two jets of abrasive powder particles" in the introduction and the claims should be considered as an embodiment in which the surface of the plate or layer is always powder-blasted at an angle. It is thus possible to place a nozzle at an angle $\alpha_1$ and to subsequently place the same nozzle at an angle $\alpha_2$, which embodiment falls within the protective scope of the present invention. It is also possible to vary the angle $\alpha_1$ at which the nozzle extends to the surface of the plate or layer continuously or not continuously, which embodiment also falls within the protective scope of the present invention. In practice, two or more separate nozzles, each with a respective angle $\alpha_1$ and $\alpha_2$ will be used from a production-technical point of view.

The term "brittle-like material" mentioned in the introduction and the claims should be considered as a material in which concave spaces or apertures can be provided by means of powder blasting, for which notably glass, ceramic material, silicon and brittle synthetic materials are suitable basic materials.

The part of the phrase "not limited by the thickness of the brittle-like material" mentioned in the introduction and claims should be understood to mean that the method is suitable for providing apertures or concave spaces in any brittle-like material or combinations of one or more brittle-like materials in which the apertures or concave spaces formed extend partly or completely across the thickness of the material or combination of materials used. The shape of the apertures or concave spaces thus formed is not defined by a possible transition of material properties, as is the case in the Japanese patent publication 082 22129 to be described hereinafter. Consequently, a hard, brittle-like material as a stopper layer is not required.

Although it is known from the Japanese patent application published under no. 082 22129 on Aug. 30, 1996 to make a concave space in a brittle-like material while using a jet of abrasive powder particles, it is necessary for the method known from this publication that the brittle-like material essentially consists of two separate materials, namely a relatively soft brittle-like material and a hard brittle-like material. The relatively soft brittle-like material is provided with a mask which is subsequently subjected to the powder-blasting treatment so that the soft brittle-like material not shielded by the mask is removed by the powder particles. The concave spaces are thus only formed in the soft brittle-like material, while the transition from the relatively soft brittle-like material to the hard brittle-like material serves as a stopper layer. A concave space thus formed has a flat bottom which is formed by the hard brittle-like material that has not been removed by the jet of abrasive powder particles. Moreover, this Japanese patent application does not give any information about the special angle of the jet of abrasive powder particles with respect to the surface of the plate or layer in which the pattern of concave spaces or apertures is formed. Frit is used as a relatively soft brittle-like material, and glass is used as a hard brittle-like material. A drawback of this technology is that a top layer of frit should always be provided on the hard brittle-like material, which treatment has a cost-increasing effect. Moreover, the released frit must be removed.

The angles $\alpha_1$ and angle $\alpha_2$ used in the method according to the invention are preferably between 30° and 80°, particularly between 45° and 65°.

The use of such angles $\alpha_1$ and $\alpha_2$ has led to concave spaces or apertures with a substantially flat bottom. If the angles $\alpha_1$, angle $\alpha_2$ are smaller than 30°, the erosion speed is low, which is undesirable for practical applications. If, in contrast, the angles $\alpha_1$, angle $\alpha_2$ are larger than 80°, the ducts formed on the lower side as compared with ducts obtained by means of powder blasting at an angle of 90° will hardly widen, which is detrimental for obtaining symmetrical concave spaces or apertures having a substantially flat bottom and substantially straight side walls. It should, however, be clear that the present invention is not limited to apertures or holes with a flat bottom and/or straight side walls. In accordance with the method, it is alternatively possible to form apertures which are interconnected under the surface. Moreover, in accordance with the present invention, apertures or concave spaces can be obtained which extend throughout the thickness of the brittle-like material.

If ducts or grooves or slits must be formed in a plate or layer of the brittle-like material, it is preferred in the present invention to perform a relative movement between the jet of abrasive powder particles and the plate or layer. For an accurate and reproducible powder supply through the nozzle, it is preferred that the nozzle is situated at a fixed point.

To prevent interference of the jets of abrasive powder particles, causing a loss of kinetic energy, it is preferred to obtain a pattern of concave spaces or apertures in steps, in which the two jets of abrasive powder particles are directed one after the other onto the surface of the plate or layer. This consecutive operation should also include the embodiment in which the formation of the apertures or concave spaces takes place with a fast alternation of both jets. In accordance with such a high-frequency alternation of both powder jets, it is possible to obtain a symmetrical concave space or aperture.

In a particular embodiment of the present invention, it is further preferred to direct the two jets of abrasive powder particles onto separate positions of the plate or layer so that the powder blasting efficiency is influenced in a favorable manner.

Experiments have proved that it is desirable that the geometry or dimension of the nozzle for both jets of powder particles is substantially identical for obtaining substantially symmetrical concave spaces or apertures in a plate or layer of the brittle-like material. Moreover, for obtaining such symmetrical concave spaces or apertures provided with a flat bottom, it is preferred that the kinetic energy determined by the size and velocity of the powder particles is substantially identical for both jets of powder particles, while it is notably preferred that angle $\alpha_1$ is equal to angle $\alpha_2$. Moreover, in such an embodiment it is preferred that the quantity of particles, namely the powder flux, is substantially identical for both jets of powder particles.

To be able to check the kinetic energy of the particles, it is necessary that both the size of the particles and their velocity should be determined accurately. In given embodiments, it is thus preferred that the abrasive powder particles have a size of between 10 and 50 $\mu$m.

For obtaining a pattern of concave spaces or apertures in a plate or layer of the brittle-like material having a depth of 85 to 200 $\mu$m, it is preferred that the mask has a thickness of between 30 and 100 $\mu$m.

The present invention also relates to a brittle-like material provided with a pattern of concave spaces to apertures, which brittle-like material is characterized by the method as described in the present invention.

The brittle-like material obtained by means of the method according to the invention is notably suitable for use in plasma display panels (PDP), plasma-addressed liquid crystal displays (PALC) and in components for micro electromechanical systems, for example, sensors, actuators and micrometering systems.

These and other aspects of the invention are apparent from and will be elucidated with reference to the embodiments described hereinafter.

It should be noted that the present invention is not limited to these special embodiments which only serve to illustrate the present invention.

DESCRIPTION OF THE PREFERRED EMBODIMENTS

Figure 1A:
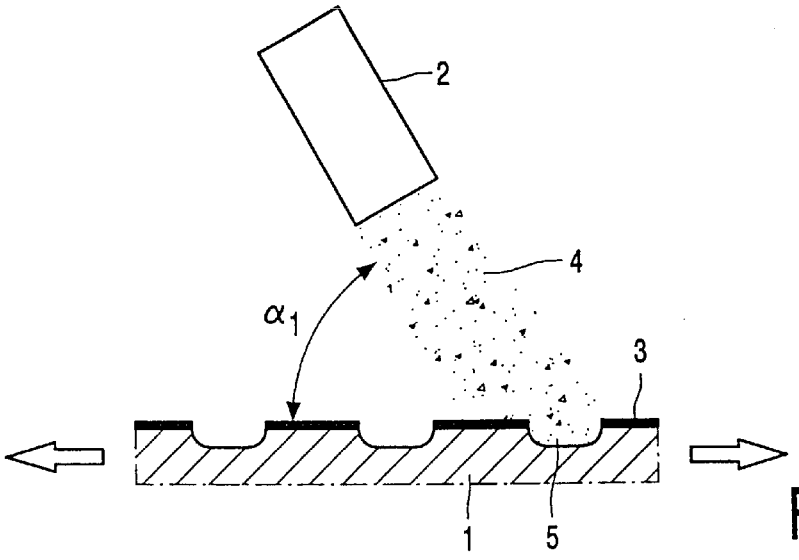
FIG. 1 shows diagrammatically the method according to the invention.
Figure 1B:
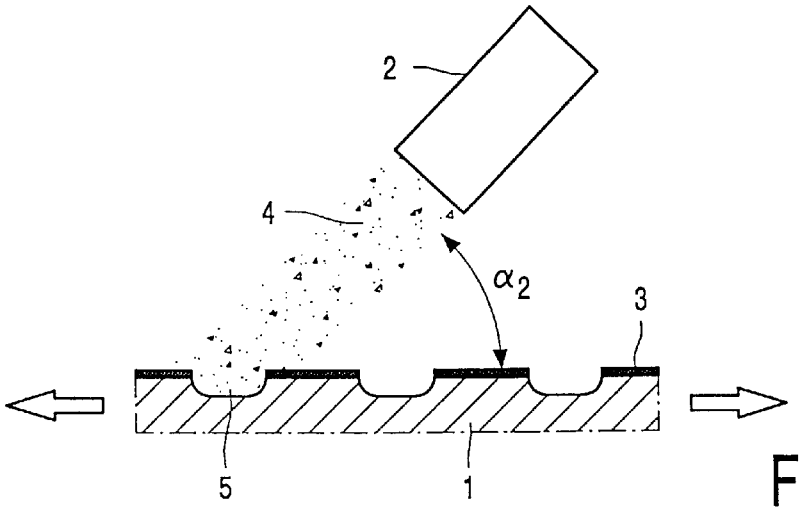
Figure 1C:
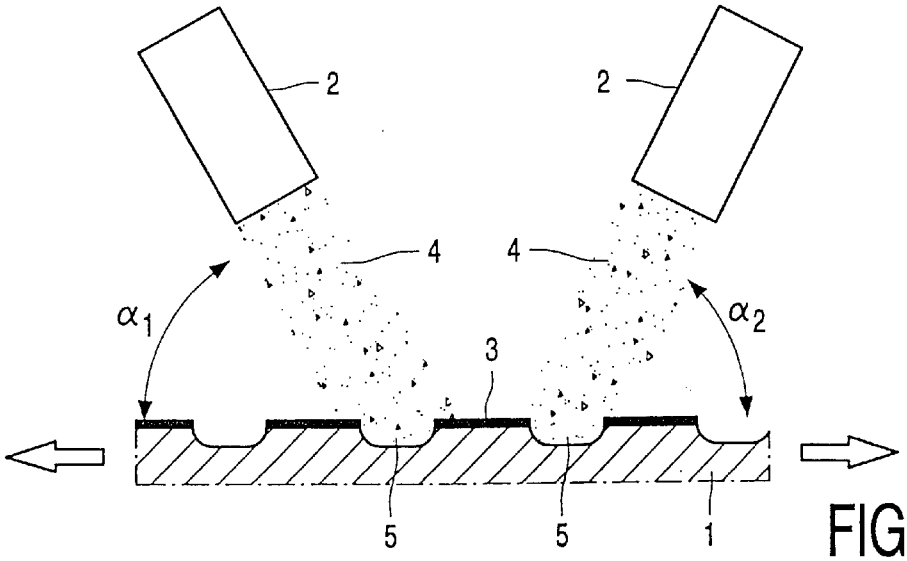
Figure 2A:
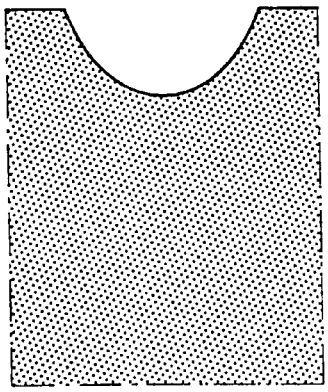
FIG. 2 is a cross-section, obtained by means of optical microscopy, of a groove pattern in a powder-blasting experiment in accordance with the state of the art.
Figure 2B:
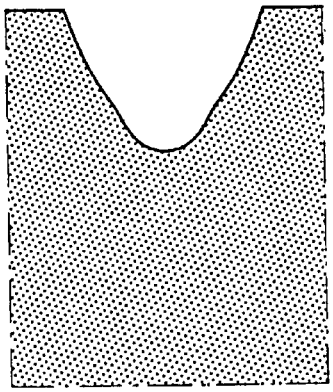
Figure 2C:
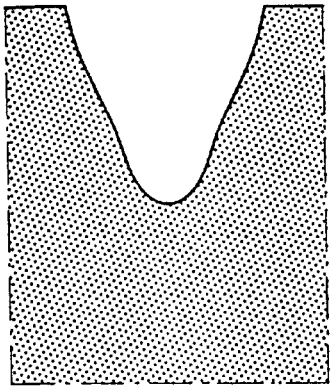
Figure 2D:
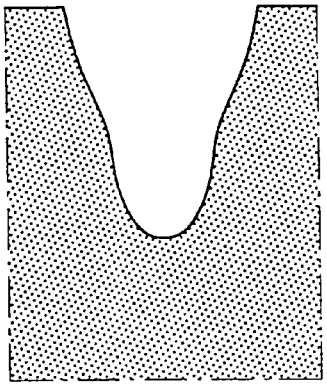
Figure 2E:
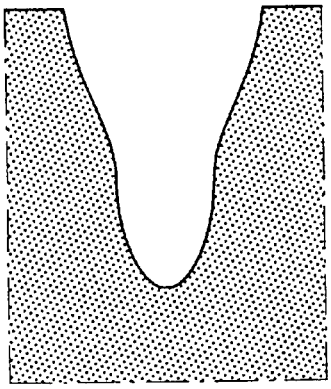
Figure 2F:
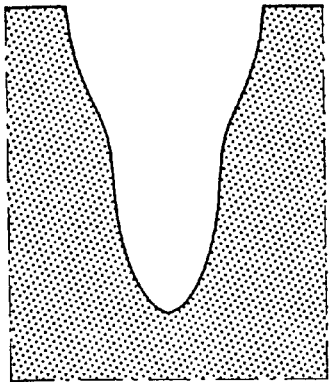
Figure 2G:
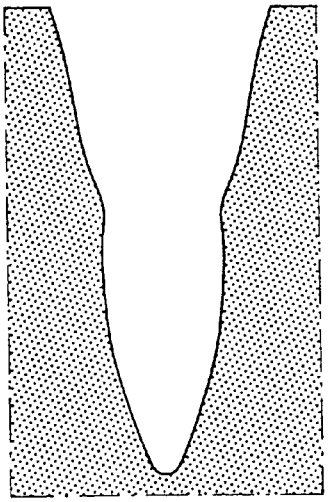
Figure 2H:
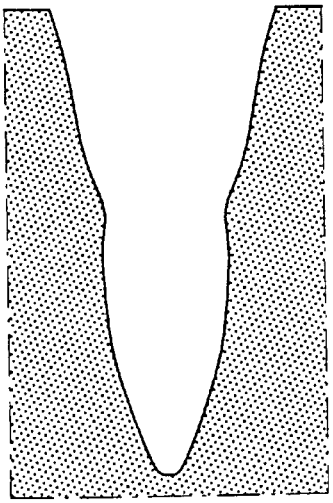
Figure 2I:
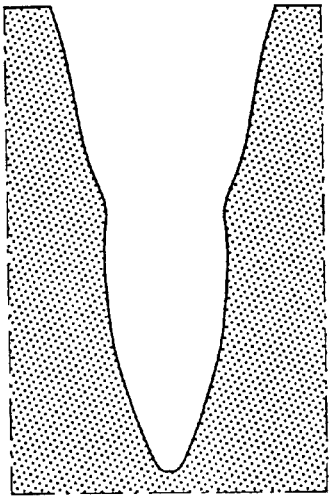

FIG. 1 shows diagrammatically the method in accordance with the present invention in the separate sub-FIGS. 1A–1C. The plate or layer of brittle-like material is denoted by reference numeral 1, on which brittle-like material a mask 3 is provided so as to define the region of impact of the abrasive powder particles 4 on the surface of the brittle-like material 1. The jet of abrasive powder particles 4 comes from a nozzle 2 which extends at an angle $\alpha_1$ to the surface of the plate or layer 1. As a result of the kinetic energy of the jet of abrasive powder particles 4, a pattern of concave spaces or apertures 5 is formed in the brittle-like material 1, while it is also desirable in a special embodiment that a relative movement is performed between the jet of abrasive powder particles 4 and the brittle-like material 1.

FIG. 1B shows the embodiment in which nozzle 2 extends at an angle of angle $\alpha_2$ to the surface of the plate or layer of brittle-like material 1. The jet of abrasive powder particles 4 is directed onto the surface of the plate or layer of the brittle-like material 1 in such a way that a pattern of concave spaces or apertures 5 is formed in the brittle-like material 1. It should be evident that the nozzle 2 used in FIGS. 1A and 1B may be the same nozzle in a special embodiment so that a pattern of concave spaces or apertures 5 in the brittle-like material 1 is obtained by varying the angles a, and angle $\alpha_2$. Moreover, it is possible to obtain a pattern of concave spaces or apertures 5 in steps, in which the two jets of abrasive powder particles 4 from nozzle 2 are consecutively directed onto the surface of the plate or layer 1.

FIG. 1C shows diagrammatically the embodiment in which two separate nozzles 2 direct a jet of abrasive powder particles 4 onto the surface of the brittle-like material 1, so that concave spaces or apertures 5 are formed in the brittle-like material 1. This diagrammatic representation also shows that the two angles $\alpha_1$, $\alpha_2$ do not need to be equal to each other. Moreover, it is desirable in a given embodiment that the two jets of abrasive powder particles 4 are directed onto separate positions 5 on the plate or layer of the brittle-like material 1. The essence of the present invention should thus be based on the recognition that a jet of abrasive powder particles is directed at an angle onto the surface of the plate or layer, which angle is smaller than the angle of 90° known from the state of the art.

FIG. 2 shows diagrammatically pictures 1–9 obtained by means of optical microscopy. The brittle-like material glass was provided with a mask of the type Ordyl BF410 having a thickness of 100 $\mu$m and a width of 370 $\mu$m between the apertures. $Al_2O_3$ having an average size of 23 $\mu$m was used for the abrasive powder particles which were directed at an average velocity of 133 m per second onto the brittle-like material. This state-of-the-art experiment was performed at an angle of incidence of 90°, namely a perpendicular incidence on the brittle-like material. The pictures 1–9 represent the apertures obtained as a function of the powder load, with picture 1 corresponding to a powder load of 17 gr/cm$^2$ and picture 9 corresponding to a powder load of 150 gr/cm$^2$, while the powder load was raised by a value of approximately 17 gr/cm$^2$ for each picture. The pictures clearly show that the shape of the aperture obtained does not have a straight side wall and/or a flat bottom. Moreover, a clearly visible kink in the geometry of the side wall occurs as from picture 4.

Figure 3A:
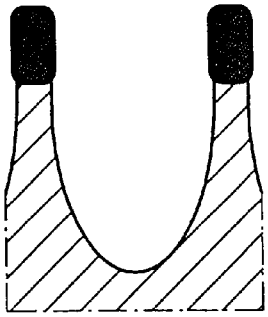
FIG. 3 is a cross-section, obtained by means of optical microscopy, of a groove pattern in a powder-blasting experiment in accordance with the present invention.
Figure 3B:
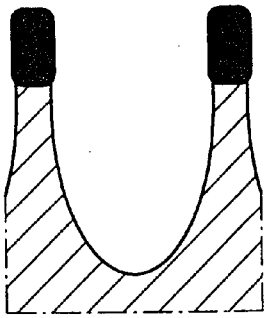
Figure 3C:
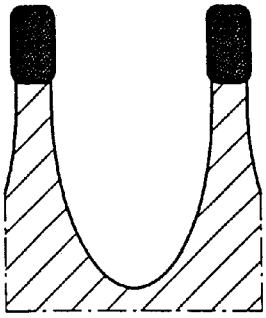
Figure 4A:
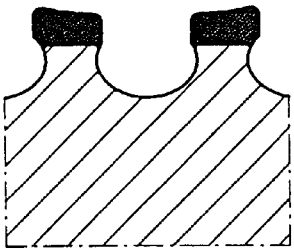
FIG. 4 is a cross-section, obtained by means of optical microscopy, of a groove pattern in a powder-blasting experiment in accordance with the present invention.
Figure 4B:
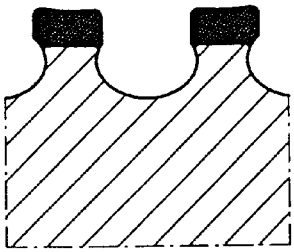
Figure 4C:
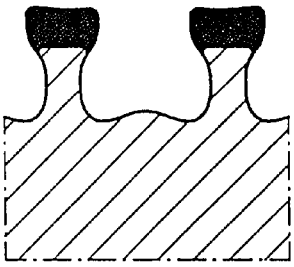
Figure 4D:
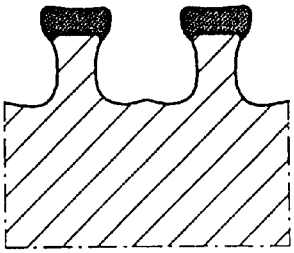
Figure 4E:
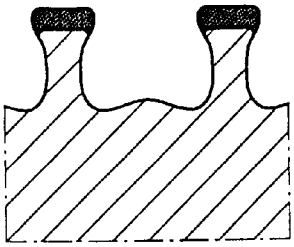
Figure 4F:
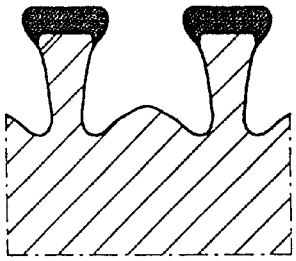
Figure 4G:
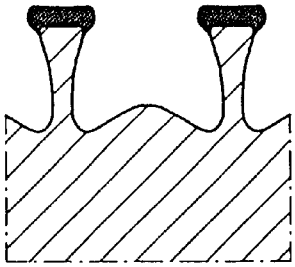
Figure 4H:
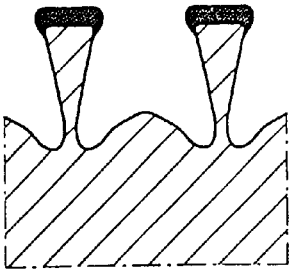
Figure 5A:
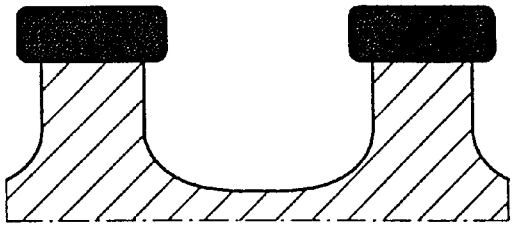
FIG. 5 is a cross-section, obtained by means of SEM, of a groove pattern in a powder- blasting experiment in accordance with the present invention.
Figure 5B:
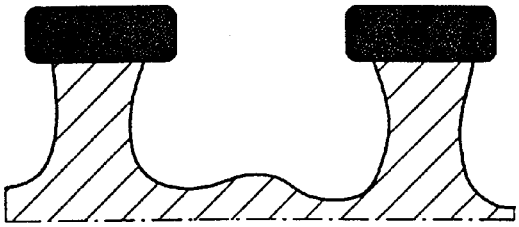
Figure 5C:
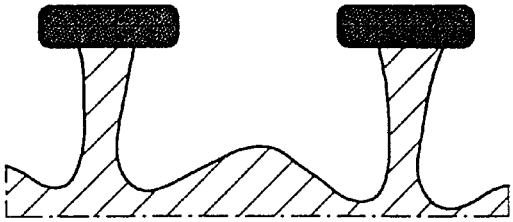
Figure 5D:
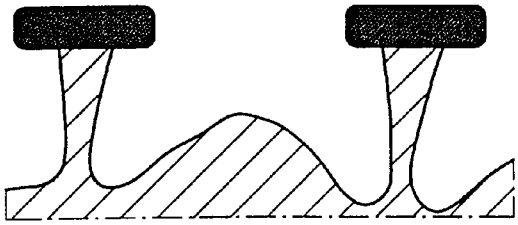

FIG. 3 shows diagrammatically a powder-blasting experiment in accordance with the present invention by means of optical microscopy pictures 1–3. The brittle-like material used was glass and its surface was provided with a blast-resistant mask having a thickness of approximately 100 $\mu$m and a width of 360 $\mu$m between the apertures. The surface was subjected to a powder-blasting treatment with $Al_2O_3$ particles having an average size of 23 $\mu$m and an average velocity of 100 m per second. The angles $\alpha_1$, $\alpha_2$ used in this powder-blasting experiment were both 75°. It is clearly visible from the optical microscopy pictures 1–3 that the shape of the apertures obtained essentially differs from the shape of the apertures as described with reference to FIG. 2, in which the angle of incidence was 90°. Picture 1 corresponds to a powder load of 42 gr/cm$^2$, picture 2 corresponds to a powder load of 52 gr/cm$^2$ and picture 3 corresponds to a powder load of 72 gr/cm$^2$. Moreover, the formation of straight side walls is visible from picture 3, with a considerable widening as compared with the pictures shown in FIG. 2.

FIG. 4 shows SEM pictures of a powder-blasting experiment in accordance with the present invention. Glass was used as a brittle-like material and was provided with a mask of the type LF55G1 having a thickness of approximately 100 $\mu$m and a width of 360 $\mu$m between the apertures. The surface was blasted with $Al_2O_3$ particles having an average size of 23 $\mu$m and an average velocity of 100 m per second. The angles $\alpha_1$, angle $\alpha_2$ used in this experiment were both 60°. Picture 1 corresponds to a powder load of 22 gr/cm$^2$, in which picture the symmetrical shape of the aperture formed in glass is clearly visible. In picture 2, the powder load was increased to 32 gr/cm$^2$, in which the flat bottom and the substantially straight side walls of the symmetrically formed aperture in the brittle-like material are clearly visible. The subsequent increase of the powder load to a value of 44 gr/cm$^2$, in picture 3, shows that the structure of the flat bottom was changed, while the side walls were also slightly undermined. An even further increase of the powder load to, for example, 88 gr/cm$^2$, in picture 8, clearly shows that the use of two jets of abrasive powder particles at an angle of 60° essentially influenced the geometry of the apertures formed. The still further increase of the powder load will ensure that the juxtaposed apertures will come into contact with each other so that apertures are obtained which are interconnected under the surface and are referred to as sub-ways.

FIG. 4 shows additional SEM pictures of the experiment performed in accordance with FIG. 4, with picture 1 clearly showing the symmetrical shape of the aperture formed. In picture 4, the flat bottom changes to a slightly convex structure which is considerably influenced after the powder load is even further increased, as is shown in picture 8.

Figure 6A:
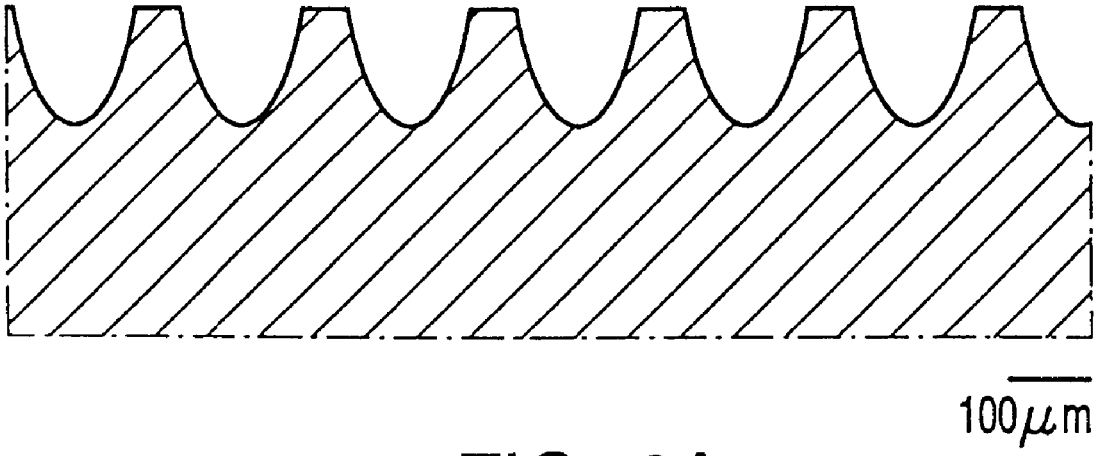
FIG. 6 is a cross-section, obtained by means of SEM, of a groove pattern in a powder-blasting experiment in accordance with the state of the art.
Figure 6B:
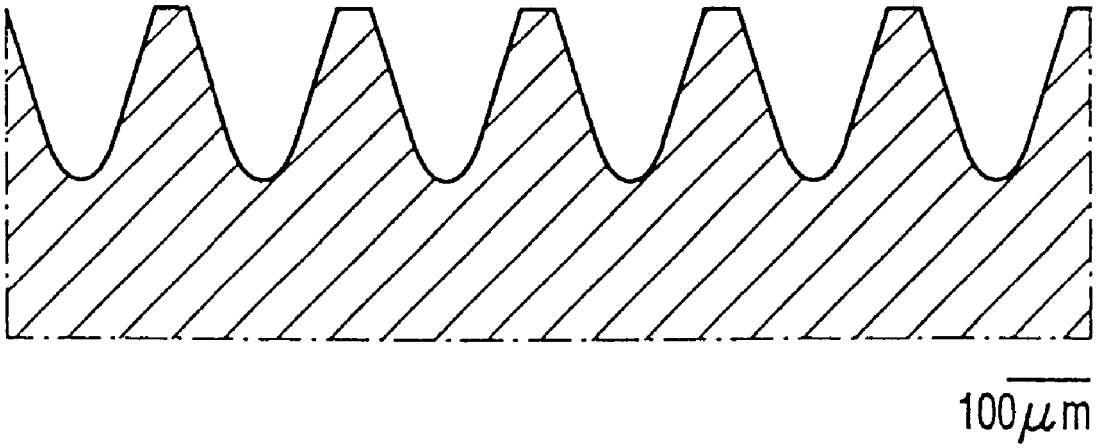

Finally, FIG. 6 shows diagrammatically a pattern of concave ducts obtained in accordance with the state of the art, which pattern is obtained at an angle of incidence of 90° in a glass substrate. It is clearly visible from this FIG. 6 that the shape of the concave apertures obtained corresponds to the picture shown in FIG. 2, noting that both the flat bottom and the straight side wall are absent.

What is claimed is:

1. A method of obtaining a pattern of concave spaces or apertures in a plate or layer of a brittle-like material, in which method a jet of abrasive powder particles from a nozzle is directed onto a surface of the plate or layer, which plate or layer is provided with a mask so as to define the region of impact of the abrasive powder particles on the surface, characterized in that at least two jets of abrasive powder particles are each directed at respective angles of $\alpha_1$ and $\alpha_2$ onto the surface of the plate or layer, which jets mutually extend at an angle of $(180°-\alpha_1-\alpha_2)$, the shape of the concave spaces or apertures thus formed being not limited by the thickness of the brittle-like material.

2. A method as claimed in claim 1, characterized in that the angles $\alpha_1$ and $\alpha_2$ are between 30° and 80°.

3. A method as claimed in claim 1, wherein the angles $\alpha_1$ and $\alpha_2$ are between 45° and 65°.

4. A method as claimed in claim 1, wherein a relative movement is performed between the jet of abrasive powder particles and the plate or layer.

5. A method as claimed in claim 4, characterized in that the plate or layer is moved with respect to the jet of abrasive powder particles.

6. A method as claimed in claim 1, wherein a pattern of concave spaces or apertures is obtained in steps, in which the two jets of abrasive powder particles are directed one after the other onto the surface of the plate or layer.

7. A method as claimed in claim 1, wherein the two jets of abrasive powder particles are directed onto separate positions on the plate or layer.

8. A method as claimed in claim 1, wherein the nozzle has a substantially identical geometry for both jets of powder particles.

9. A method as claimed in claim 1, wherein the powder particles in both jets have a substantially identical average kinetic energy.

10. A method as claimed in claim 1, wherein both jets of powder particles have a substantially identical powder flux.

11. A method as claimed in claim 1, wherein angle $\alpha_1$ is equal to angle $\alpha_2$.

12. A method as claimed in claim 1, wherein the abrasive powder particles have a size of between 10 and 50 $\mu$m.

13. A method as claimed in claim 1, wherein the mask has a thickness of between 30 and 100 $\mu$m.

14. A brittle-like material provided with a pattern of concave spaces or apertures, wherein the method is performed as claimed in claim 1.

15. A brittle-like material as claimed in claim 14, characterized in that the concave spaces or apertures have a substantially flat bottom.

16. A brittle-like material as claimed in claim 14, wherein the concave spaces or apertures have substantially straight side walls.

17. A brittle-like material as claimed in claim 14, wherein the concave spaces or apertures are interconnected under the surface of the plate or layer.

* * * * *